US005107687A

United States Patent [19]

Candeloro

[11] Patent Number: 5,107,687

[45] Date of Patent: Apr. 28, 1992

[54] AIR CONDITIONING SYSTEM

[75] Inventor: Francesco Candeloro, Cadro, Switzerland

[73] Assignee: Ventilplafon, S.A., Grancia, Switzerland

[21] Appl. No.: 613,472

[22] PCT Filed: Jan. 17, 1990

[86] PCT No.: PCT/EP90/00090

§ 371 Date: Jan. 11, 1991

§ 102(e) Date: Jan. 11, 1991

[87] PCT Pub. No.: WO90/10827

PCT Pub. Date: Sep. 20, 1990

[30] Foreign Application Priority Data

Mar. 12, 1989 [CH] Switzerland ..... 89104375.4

[51] Int. Cl.[5] ..... F24F 3/08; F24F 11/02; F24F 13/072

[52] U.S. Cl. ..... 62/259.1; 52/39; 165/48.1; 62/DIG. 16; 454/304

[58] Field of Search ..... 62/440, 264, DIG. 16, 62/329, 259.1; 98/34.6, 31.6, 42.18, 40.14, 40.16, 38.8, 42.09, 40.17; 52/27, 39; 165/48.1, 103

[56] References Cited

U.S. PATENT DOCUMENTS

| | | | |
|---|---|---|---|
| 843,909 | 2/1907 | Peters et al. | 165/20 |
| 2,022,143 | 11/1935 | Mottershall | 98/42.18 |
| 2,628,083 | 2/1953 | Rerse | 62/264 |
| 2,821,897 | 2/1958 | Kreuttner | 98/40.17 |
| 3,093,058 | 6/1963 | LaVigne et al. | 98/40.17 |
| 3,246,477 | 4/1966 | Gable et al. | 62/259.1 |
| 4,178,840 | 12/1979 | Caknis | 98/40.17 |
| 4,641,503 | 2/1987 | Kobayashi | 62/259.1 |
| 4,844,283 | 7/1989 | Justus | 98/40.17 |
| 4,955,997 | 9/1990 | Robertson | 98/33.1 |

FOREIGN PATENT DOCUMENTS

| | | | |
|---|---|---|---|
| 0197923 | 9/1986 | Japan | 165/48.1 |

*Primary Examiner*—Albert J. Makay
*Assistant Examiner*—William C. Doerrler
*Attorney, Agent, or Firm*—Helfgott & Karas

[57] ABSTRACT

A system suitable for air conditioning rooms comprising a heating/cooling unit, distribution pipes and discharge units is, in the interest of increasing flexibility of installation and operation, constructed in modular fashion, and has a shape that permits installation on top of a suspended ceiling. In addition, the flow of air through each separate discharge unit can be individually adjusted.

19 Claims, 3 Drawing Sheets

AIR CONDITIONING SYSTEM

BACKGROUND OF THE INVENTION

The present invention relates to a system which, in order to be able to condition the air in a number of rooms, comprises a heating/cooling unit, distribution pipes and discharge units.

In some prior art building air conditioning systems, a centrally-located heating/cooling unit is employed to provide a large number of rooms with cool, conditioned air. Use of such prior art systems causes the conditioned air supplied to all of the rooms to be thermodynamically uniform, i.e. the air supplied to all of the rooms has the same temperature and humidity.

The situation inside a building of the rooms to be air-conditioned (i.e. north or south exposure) and the use for which each room is intended (number of persons present, whether or not heat-emitting devices are being operated inside the room, etc.) determine the optimal temperature and humidity levels for the conditioned air that is to be supplied to each individual room.

SUMMARY OF THE INVENTION

The object of the present invention, therefore, is the development of an air conditioning system that allows for maximum adaptability to the particular temperature and humidity levels of the air present in each room. The design of the proposed system must, besides permitting functional adaptability, lend itself both to inexpensive production methods and ease of servicing.

It is proposed that the above objects be satisfied by an arrangement of a prior art air conditioning system whose construction is modular, whose vertical height, by not surpassing 22 cm, permits installation in a suspended ceiling, and the configuration of whose discharge units permits regulation of the circulation of conditioned air in accordance with conditions prevailing in each of the rooms to be air conditioned. The proposed air conditioning system embraces the following distinguishing features that are required to provide a high degree of operational flexibility: the modular construction of the proposed air conditioning system both permits reduction of production costs to a level at which a complete heating/cooling unit can be installed in each room at a cost comparable to that of the installation of conventional central systems, and permits regulation of the thermodynamic characteristics of the supplied air to the particular environmental characteristics of each room.

The arrangement of the entire system in a suspended ceiling obviates its taking up otherwise useful space. In addition, the spatial proximity of the heating/cooling unit to the discharge units permits the use of much shorter distribution pipes.

The modular arrangement of the proposed system moreover permits any number of combinations of its discrete components. This feature gains strength from its combination with the shape of the system, and permits installation in a suspended ceiling. The proposed component configuration permits ready access to individual components of the air conditioning system, an advantage that implies that the proposed system can easily be modified for use in a number of different roles. By way of example, if the use of any given room is changed (e.g. furnished with heat-emitting equipment) or if the sectioning of a given enclosed area is changed (e.g. by shifting the positions of moveable partitions in a open-plan office), the heating/cooling unit can be easily replaced by a unit having different performance characteristics. The modular construction, which lends itself well to long and profitable production runs, moreover permits relatively low cost production of the proposed air conditioning system, which allows the system to be fully competitive with conventional central air conditioning systems.

The configuration of the discharge units, by permitting the flow of air to be individually regulated by each of such units, allows each of the several areas of any given room to be fed with conditioned air in accordance with different conditions prevailing in each of such areas.

In order for each discharge unit to be able to optimally modify the flow of air in accordance with the individual requirements of each room, a preferred embodiment of the proposed air conditioning system provides for the fitting to each discharge unit of a pair of swingable flaps, the size of the cross section of airstream released by which depending on the position in which such flaps are set. The flaps are joined by their outer longitudinal edges to bearing members so as to be able to swing in the manner of a hinge, while their inner longitudinal edges interact with one or more plates which can be slid in the vertical direction, a motion that causes the flaps to open or close. Thus, for example, the supply of air to each work area within a single given room can be adjusted individually; this arrangement furthermore permits, through suitable adjustment of the flow of air through the individual discharge units, influence of the general air-circulation pattern inside the air-conditioned room.

An advantageous configuration of the proposed air conditioning system comprises that the vertical adjustment of the plate be accomplished by means of an adjusting screw that is accessible from the bottom. This arrangement allows—given an adjusting screw of suitable shape, and even without using an adjusting tool—the flaps to be repositioned quickly and thus also the discharged, conditioned air to be rapidly redirected, where required, inside any given room. Nylon would be well suited for producing both the plate and the adjusting screw.

In another effective configuration of the proposed air conditioning system, the flaps comprise along one or more frontal faces, in extension of the inner longitudinal edges, projections that fit into one—or more—panels. The outer longitudinal edges of the flaps comprise, advantageously, a lip of circular cross section, whose interaction with a correspondingly-shaped recess in the bearing members of the discharge unit permits hingelike motion. Such an articulated connection between the flaps and the bearing members is exceptionally advantageous from the point of view of cost; the mounting of the flaps requires merely that the flaps be slid in the longitudinal direction into the recesses located in the bearing members.

Arranged above the flaps, and between the bearing members, is a perforated plate that serves to distribute the flowing air even)y along the integral length of the proposed discharge unit. Without such perforated plate, the air flowing through the discharge units would, under certain circumstances, be greater and/or uneven in the vicinity of the point at which the air flows out of the distribution pipes into the discharge unit, compared to those zones that are further away from the point at which the air flows from the distribution pipe into the discharge unit.

The proposed discharge units advantageously comprise devices that act to prevent the stream of conditioned air from exiting vertically downward and rather redirect such airstream downward laterally at an angle. It is preferable that such a device comprise a diffuser comprising a plurality cf airflow ducts sectioned off by vanes, the exit portions of such ducts being directed downwardly at an angle toward the room to be air-conditioned. The type of diffuser employed in the embodiment presently being considered comprises preferably two groups of three airflow ducts each, through which the air is expelled at an angle in two different directions. This arrangement markedly reduces the danger of the occurence of a draft. It is preferable that the angle at which the air outflow openings diverge from the vertical be approximately between 45° and 60°.

Because in this embodiment the diffuser connects to the bearing members via interlocking guides, installation is greatly facilitated. A material that is well suited to the production of the diffusers is Denilen. (Trademark owned by the Deniplast Co.) Optimal adaptation of the proposed air conditioning system to local requirements is made possible because the direction in which the air exits from the discharge units can be influenced and individually regulated. Such adjustment of the direction in which air is expelled from the unit is enabled advantageously by means of a horizontally-slewable dividing wall that is situated inside a downwardly-oriented discharge slot of the proposed discharge unit. In this manner, the discharge direction can be regulated just as easily as can the airflow volume; if the dividing wall and/or discharge slot is suitably shaped, no implements are required to perform the adjustment.

In order to be able to redirect the exiting stream of air at an angle to the outside, the dividing wall comprises at its lower extremity preferably a substantially triangular airflow deflector that widens toward the bottom. The exiting airflow can be deflected more easily if the section of the airflow deflector having the greatest width approaches the width of the discharge slot itself.

The method by which the dividing wall can be caused to pivot horizontally comprises that the dividing wall comprise on its upper edge two or more arc-shaped fork elements that are accomodated in a trough that both features the outflow slot and constitutes the lower extremity of the outflow unit; hence, it is advantageous that the trough have an arc-shaped cross section permitting mating with the fork elements. The latter, and the areas of the trough with which they interact, preferably comprise a tooth-shaped locking mechanism that serves to hold the dividing wall securely in the position into which it has been adjusted. Thus, the dividing wall is prevented from slipping out of the position into which it has been set (e.g. by the force of the airstream). Both trough and bearing members are, in addition, connected together by means of interlocking guides in order to facilitate installation.

An easily-workable, flame-retardant Alkylbenzol-sulfonate plastic is well-suited for the production of bearing members and flaps as well as the trough and dividing wall.

The heating/cooling unit of the proposed air conditioning system comprises a heating battery and a cooling battery that are preferably installed in sequence in the direction of the flowing air, an arrangement that allows the heating/cooling unit to be flat enough to be installed on top of a suspended ceiling.

The arrangement of the cooling battery upstream of the heating battery permits the heating/cooling unit to be used to dehumidify the sucked-in surrounding air. This configuration allows the inflowing air to be first cooled down below its saturation temperature with the aid of the cooling unit which causes the airborne water to condense out; the now dehumidified air is then heated to the appropriate temperature by means of the heating battery located downstream of the cooling battery. Operating in conjunction with both cooling battery and heating battery is a bypass duct through which the air can be conducted about either battery. In this arrangement, the flow of air through the device is regulated by means of a pair of bidirectional control flaps which act to reduce the cross section of the air that flows through the bypass duct to a value that equals the cross section of the airflow that it permits to flow through either the cooling or heating battery. In this configuration, the position of the bidirectional flaps can—depending on the temperature and/or humidity levels desired in the conditioned air to be returned to the room—be adjusted so as to permit the air to flow either through only the cooling battery, or through only the heating battery, through both batteries, or entirely around both batteries.

The air that has been sucked in from the outside can be easily cleaned if a filter screen serving to remove airborne particles is fitted inside the proposed heating-/cooling unit. Servicing of the filtration system is facilitated by an arrangement that permits the filter screen to be pulled out from below the cooling/heating unit. Thus, a clogged filter screen can be easily replaced by a clean one. The proposed air conditioning system can be adapted for use in clean rooms if installed inside the heating/cooling unit is an ultraviolet lamp which, by irradiating inflowing air, acts to kill any bacteria borne in such air.

Next shall be described with the aid of drawings a preferred embodiment of the proposed system serving to condition the air in individual rooms.

DETAILED DESCRIPTION OF THE PREFERRED EMBODIMENTS

Figure 1:
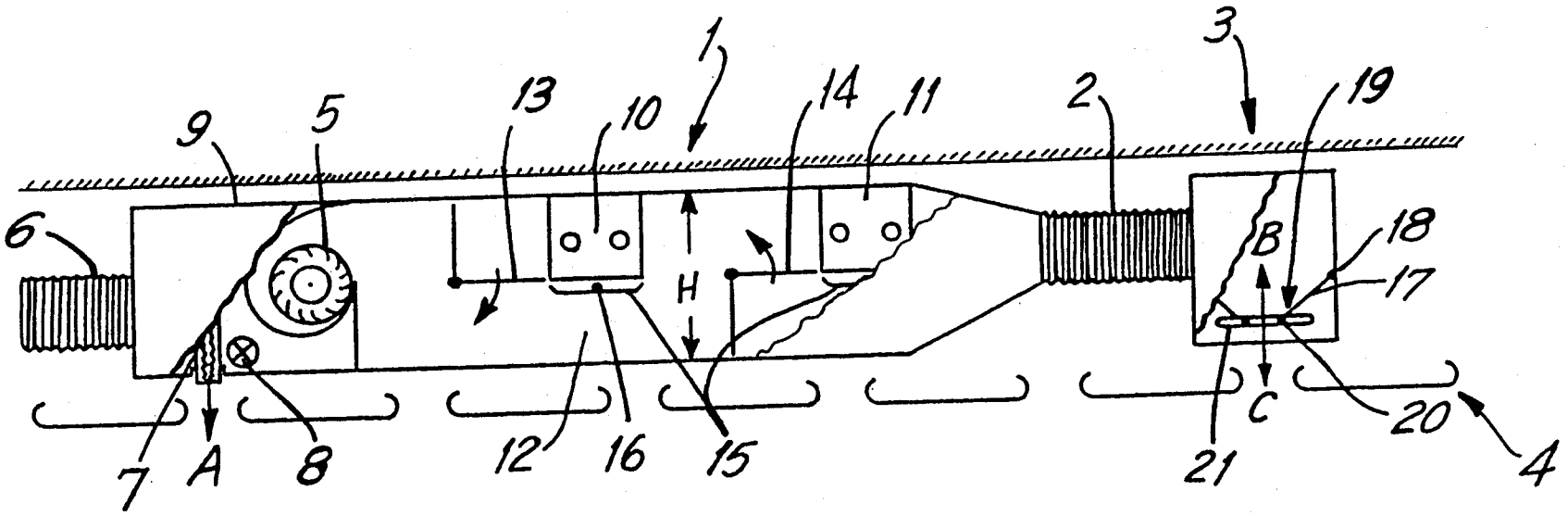
FIG. 1 - a partially broken-away lateral view of the entire proposed system.

In FIG. 1, the proposed air conditioning system, which comprises a heating/cooling unit 1, a distribution pipe 2 and a discharge unit 3, is installed above a suspended ceiling 4. Heating/cooling unit 1 comprises a blower 5 configured as a drum-type aerator, which acts to suck in, through an intake pipe 6, unconditioned air from the outside.

The sucked-in air traverses a filter 7 that is located between intake pipe 6 and blower 5 and is then irradiated with ultraviolet light from a ultraviolet lamp 8. Filter 7 comprises a filter screen which, for the purpose of its replacement (arrow A), is capable of being pulled out from casing 9 of heating/cooling unit 1 towards the bottom.

Further arranged inside heating/cooling unit 1 is a cooling battery 10 and a heating battery 11; in this configuration of the proposed system, the height of both cooling and heating batteries 10, 11 is one-half of the height H of heating/cooling unit 1; the height difference thus produced results in the formation on the inside of the heating/cooling unit 1 of bypass ducts 12 running parallel to cooling and heating batteries 10 and 11. Two bidirectional control flaps 13, 14, serve to direct the flow of air either through cooling battery 10, heating battery 11, or through bypass ducts 12. Whenever bidirectional control flaps 13, 14 are positioned as in FIG. 1, the air is caused to flow past cooling battery 10 through bypass duct 12 and on through heating battery 11.

Arranged beneath cooling battery 10 and heating battery 11 are catch trays 15, in which the water, which has been caused to condense, primarily out of cooling battery 10, can be collected, given appropriate temperature/humidity levels. The water collected in catch trays 15 is drained off through a drainage tube 16.

The now conditioned air is forced through distribution pipe 2 to discharge unit 3. Situated in the latter is a pair of flaps 17, arranged so as to be able to swing about their outer longitudinal edge 18. The inner longitudinal edges 19 of such flaps comprise protrusions 20 that are able to fit into a plate 21. Vertical displacement of plate 21 (arrows B, C) causes flaps 17 to either open or close. This arrangement permits discharge unit 3 to regulate the volume of exiting air.

Figure 2:
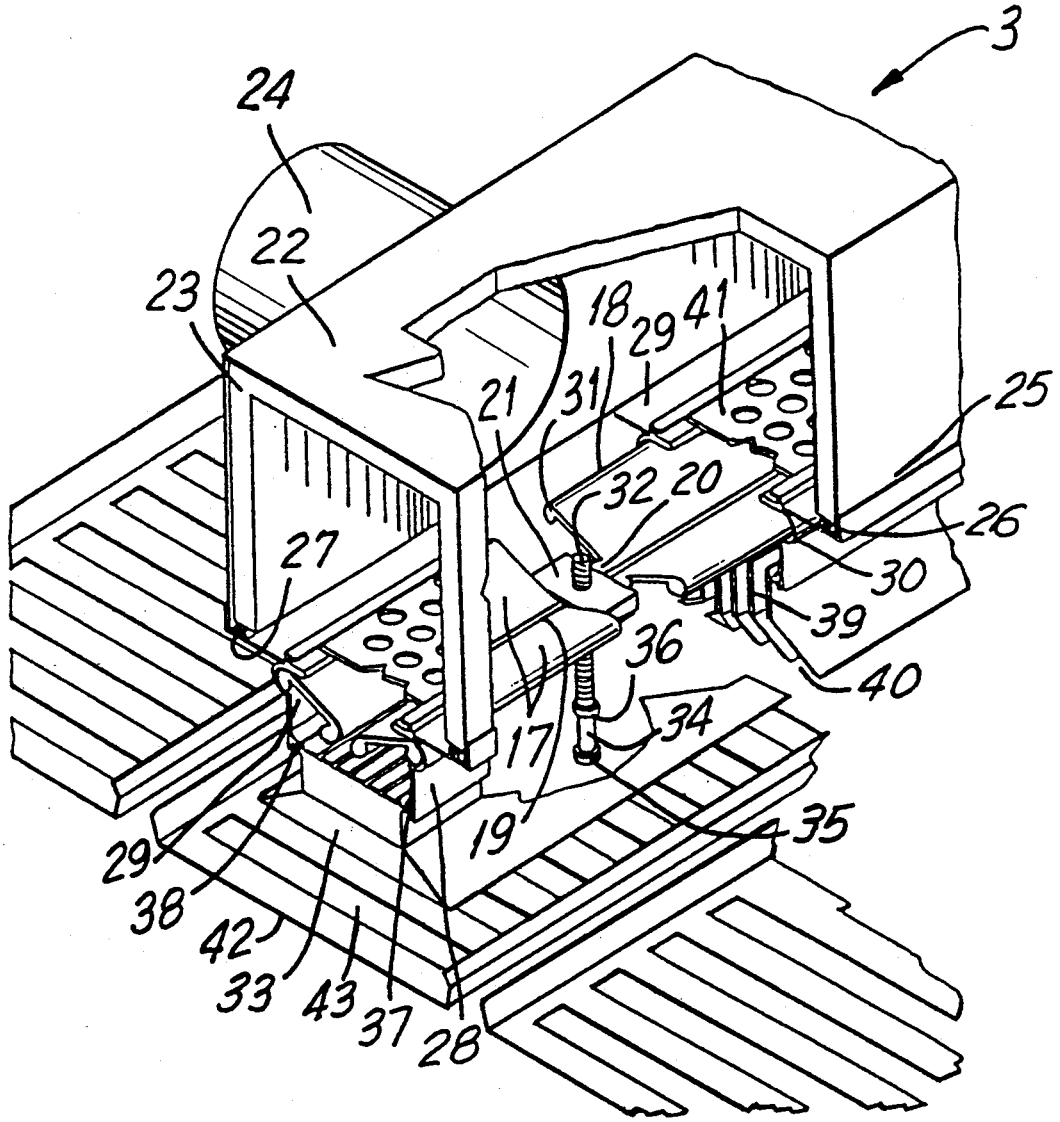
FIG. 2 - a perspective view of a preferred embodiment of the proposed discharge unit.
Figure 3:
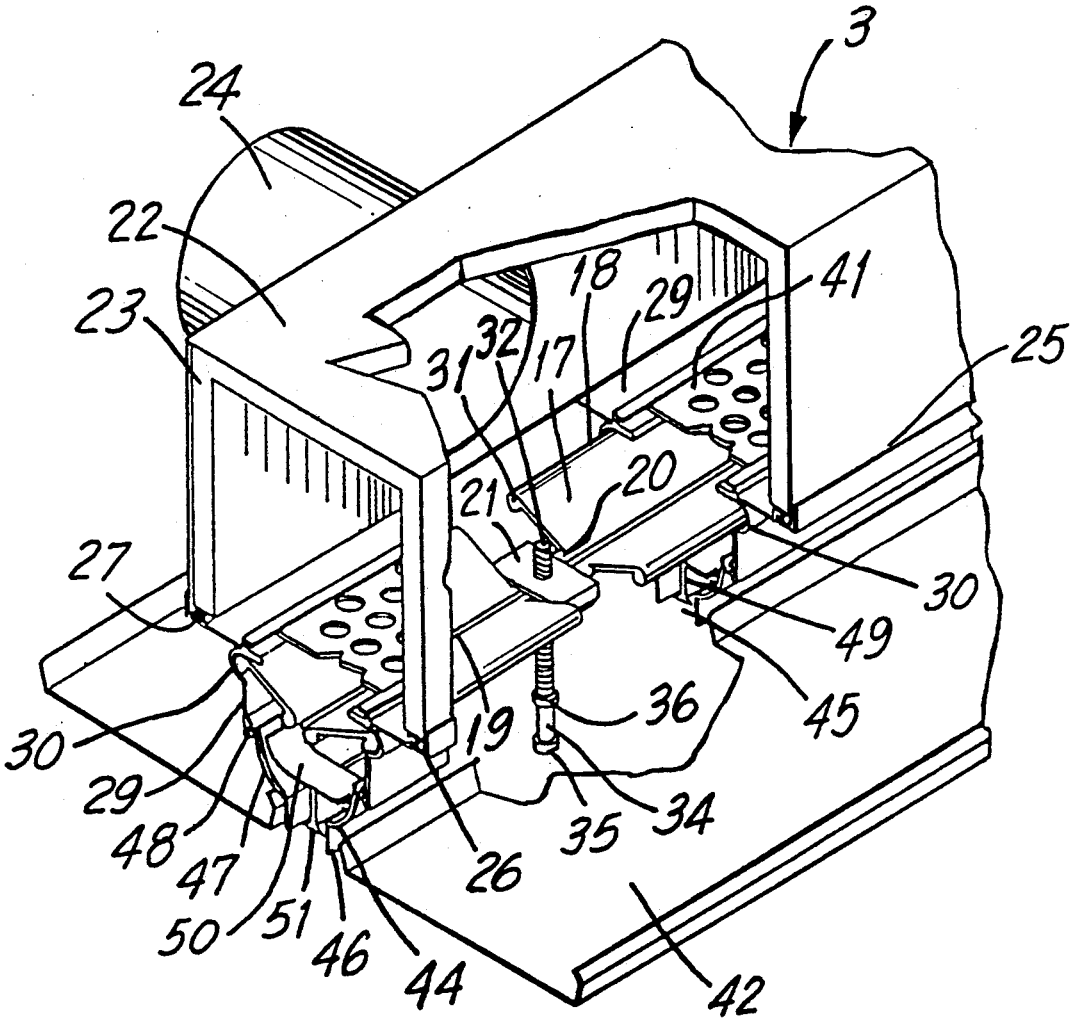
FIG. 3 - a further embodiment of the proposed discharge unit.

Preferred embodiment examples of discharge unit 3 are illustrated in FIGS. 2 and 3. A duct 22 comprises on its inner surface a layer of insulating material 23 as well as a nozzle 24 permitting connection to distribution pipe 2 shown in FIG. 1. Duct 22 has a U-shape and is attached, along its bottom longitudinal edges 25, by means of interlocking guides 26, 27, to two bearing members 28, 29. The latter comprise along their longitudinal length recesses 30 that describe approximately $\frac{2}{3}$ of the arc of a circle.

Flaps 17 comprise on their outer longitudinal edges 18 lips 31 of circular cross section that permit their hingelike articulation in recesses 30 of the bearing members 25, 29, respectively.

Protrusions 20, which are situated along the inner longitudinal edges 19 of flaps 17, fit into plate 21 and can be actuated by the latter. Plate 21 can be vertically adjusted by means of an adjusting screw 32 which is rigidly fixed in the axial direction. Adjusting screw 32 is rigidly fixed in the axial direction by means of a (not illustrated) bearing located inside diffusor 33 that interacts with the bearing portion 34 of adjusting screw 32, whereby such portion 34 is delimited by head 35 and a collar 36. Rotation of adjusting screw 32 causes plate 21 to change its vertical position, which in turn changes the size of the gap separating flaps 17.

Diffuser 33 is connected to bearing members 28, 29, by means of interlocking guides 37, 38. Diffuser 33 comprises vanes 39 that define airflow channels 40. If the lower portions of vanes 39 are angled, the lower segments of said airflow channels will also assume such an angle, which in turn will cause the airstream to exit downwardly at such an angle.

Arranged between bearing members 28, 29 is a perforated plate 41, which, serving to evenly distribute the exiting airstream, is also attached to the bearing members by means of interlocking guides.

In the embodiment of the proposed discharge units presently being considered, panels 42 of the suspended ceiling comprise apertures 43 that are both oriented across the longitudinal direction of the panel and permit the air exiting from the discharge units to enter the room.

In the embodiment of the discharge unit shown in FIG. 3, diffuser 33, which is shown in FIG. 2, is replaced by a device that controls the direction of the exiting airflow. This device comprises a trough 44, which, along its longitudinal extension, comprises an outflow slot 45. The latter is formed by the two parallel walls 46 of the lower portion of trough 44. The upper portion of trough 44 comprises concavely-curved walls 47 that comprise along their upper edges guides 48 serving to connect to bearing members 28, 29. Inside outflow slot 45 is a dividing wall 49 that comprises on its upper edge forked elements 50. The latter are curved in such a way as to be able to fit into the concavely-curved walls 47 of trough 44, thus permitting forked elements 50 to sit inside trough 44, which in turn permits the former to pivot about the longitudinal axis of trough 44. This arrangement permits adjustment of the position of dividing wall 49 inside outflow slot 45. A triangular airflow deflector 51, which widens towards the bottom and is situated on the bottom edge of dividing wall 49, acts to redirect the air, as it exits through outflow slot 45, to exit at angle to the vertical.

In the embodiment of the proposed discharge unit shown in FIG. 3, adjusting screw 32 is axially secured inside trough 44 at is bearing section 34 in a (not illustrated) bearing. Parallel walls 46, which border outflow slot 45 are, in the present embodiment, arranged between two panels 42 of the suspended ceiling. This permits use of solid, continuous-surface panels. Because the discharge unit described in FIG. 3 corresponds to that of FIG. 2, it will be appreciated that references made in respect of FIG. 2 apply equally to the embodiment described in FIG. 3.

I claim:

1. Air-conditioning system suitable for air conditioning of rooms, comprising a heating/cooling unit, distribution pipes and discharge units, said system having a modular construction and having a height (H) not exceeding 22 cm, which permits installation of said system in a suspended ceiling, wherein flow of conditioned air through each individual discharge unit (3) can be individually adjusted, wherein each discharge unit (3) comprises, in order to regulate the discharge of air, at least one horizontal, vertically displaceable plate (21), two bearing members (28, 29) and at least one pair of flaps (17) joined by their outer longitudinal edges (18) to the bearing members (28, 29) so as to be able to pivot and having inner longitudinal edges (19) which interact with said at least one plate (21) for closing and opening said flaps (17) as said at least one plate is vertically displaced.

2. System in accordance with claim 1, wherein the position of said at least one plate (21) can be adjusted by means of an adjusting screw (32) that can be accessed from the bottom.

3. System in accordance with claim 1, wherein said flaps (17) comprise along their inner longitudinal edges (19) protrusions (20) that fit into said plate (21).

4. System in accordance with claim 1, wherein each of said flaps (17) includes on said outer longitudinal edge (18) thereof a raised portion (31) having a circular cross section, each bearing member including a correspondingly-shaped recess (30) with which the respective raised portion (31) cooperates to form a hinge connection.

5. System in accordance with claim 1, further comprising a perforated plate (41) arranged above said flaps (17) between said bearing members (28, 29).

6. System in accordance with claim 1, wherein said discharge unit (3) comprises a diffuser (33) comprising airflow ducts (40) which are divided into streams by a plurality of vanes (39), said airflow ducts being oriented downwardly at an angle to the vertical.

7. System in accordance with claim 6, wherein said airflow ducts (40) are angled approximately between 45° and 60° relative to the vertical.

8. System in accordance with claim 6, wherein said diffuser (33) and said bearing members (28, 29) are connected to each other by interlocking guides (37, 38).

9. System in accordance with claim 1, wherein a direction of the flow of air from each discharge unit (3) can be individually regulated.

10. System in accordance with claim 9, wherein said discharge unit (3) comprises a downwardly-oriented exit slot (45) in which a dividing wall (49) is arranged so as to be able to pivot about a horizontal axis.

11. System in accordance with claim 10, wherein said dividing wall (49) comprises at its lower extremity a triangular airflow deflector (51) which widens toward the bottom.

12. System in accordance with claim 10, and further comprising a trough (44) and curved fork elements (50) and wherein said dividing wall (49) is accommodated by at least two arc-shaped fork elements (50) inside said trough (44) so as to be allowed to pivot, said trough constituting a lower extremity of discharge unit (3) and including an outflow slot (45) including two parallel walls (46) and having a cross section in a zone of said fork elements (50) that corresponds to a curvature of said fork elements.

13. System in accordance with claim 12, wherein said fork elements (50) and zones of concavely-curved walls (47) of said trough (44) that interact with said fork elements form a locking mechanism by means of which said fork elements (50) are permitted to assume a number of discrete positions relative to said trough (44).

14. System in accordance with claim 12, wherein said trough (44) and bearing members (28, 29) are connected together by means of interlocking guides (48).

15. System in accordance with claim 1, wherein the heating/cooling unit includes a cooling battery (10) and a heating battery (11) arranged in sequence in the direction in which air flows through said heating/cooling unit (1), bypass ducts (12), and two bidirectional control flaps (13, 14) to cause air to flow through said cooling and heating batteries and through the bypass ducts (12) situated below said batteries.

16. System in accordance with claim 1, wherein the heating/cooling unit (1) comprises a filter (7) formed as a filter screen, said filter being capable of being pulled in a direction outwards of a casing (9) of the cooling/heating unit (1) and reinserted into said casing from a bottom thereof.

17. System in accordance with claim 1, further comprising an ultraviolet lamp (8) arranged inside said unit (1) and operated to irradiate with ultraviolet light the air that flows through said unit.

18. Air-conditioning system suitable for air conditioning of rooms, comprising a heating/cooling unit, distribution pipes and discharge units, said system having a modular construction and having a height (h) not exceeding 22 cm, which permits installation of said system in a suspended ceiling, wherein flow of conditioned air through each individual discharge unit (3) can be individually adjusted, wherein each discharge unit (3) comprises, in order to regulate the discharge of air, at least one vertically displaceable plate (21), two bearing members (28, 29) and at least one pair of flaps (17) joined by their outer longitudinal edges (18) to the bearing members (28, 29) so as to be able to pivot and having inner longitudinal edges (19) which interact with said at least one plate (21) for closing and opening said flaps (17) as said at least one plate is vertically displaced, said flaps including along the inner longitudinal edges (19) thereof protrusions (20) which fit into said plate (21).

19. System in accordance with claim 18, wherein each of said flaps (17) includes on said outer longitudinal edge (18) thereof a raised portion (31) having a circular cross section, each bearing member including a correspondingly-shaped recess (30) with which the respective raised portion (31) cooperates to form a hinge connection.

* * * * *